United States Patent [19]

Johansson

[11] Patent Number: 4,707,026

[45] Date of Patent: Nov. 17, 1987

[54] MOBILE ROCKING WHEELCHAIR WITH POSITION LOCKING MEANS

[76] Inventor: Paul J. Johansson, 1416 Grant Rd., Northbrook, Ill. 60062

[21] Appl. No.: 870,249

[22] Filed: Jun. 2, 1986

[51] Int. Cl.[4] ..... A47D 13/10; A47C 3/02

[52] U.S. Cl. ..... 297/281; 297/416; 297/270; 297/DIG. 4; 297/430; 248/370

[58] Field of Search ..... 297/281, 282, 270, 416, 297/273; 248/370

[56] References Cited

U.S. PATENT DOCUMENTS

| | | | |
|---|---|---|---|
| 383,808 | 5/1888 | Hall | 248/370 X |
| 482,167 | 9/1892 | Dennett | 248/370 |
| 1,544,187 | 6/1925 | Schroeder | 297/281 |
| 2,283,000 | 5/1942 | Feldman | 297/273 X |
| 2,302,387 | 11/1942 | Greeno et al. | 248/370 |
| 2,653,649 | 9/1953 | Linquist | 297/416 |
| 2,815,067 | 12/1957 | Richardson | 297/416 X |
| 3,134,627 | 5/1964 | Mason | 297/416 |
| 3,455,600 | 7/1969 | Secor et al. | 297/270 X |
| 4,054,317 | 10/1977 | Stumpf | 297/416 |
| 4,108,415 | 8/1978 | Hauray et al. | 297/281 |
| 4,536,029 | 8/1985 | Rogers | 297/281 |

*Primary Examiner*—Francis K. Zugel

*Attorney, Agent, or Firm*—Silverman, Cass, Singer & Winburn, Ltd.

[57] ABSTRACT

A mobile rockable wheelchair having releasable locking means for locking the chair seat thereof in a substantially non-inclined position for exiting from the chair. The means for enabling rocking movement of the chair seat is achieved by a parallel four bar linkage assembly connected between the mobile pedestal, seat and backrest unit of the chair. A releasing lever arrangement is located within convenient reach of the chair's occupant. Adjustable and removable arm rest members are provided mounted on a common support frame for the seat and backrest unit of the chair. The support frame is suitable for mounting a variety of different chair seat and backrest units.

5 Claims, 13 Drawing Figures

FIG. 1
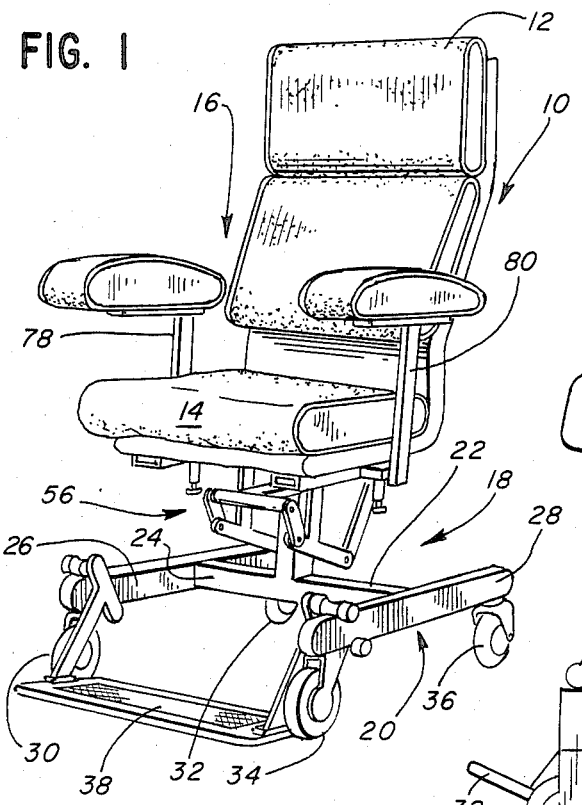
FIG. 3A
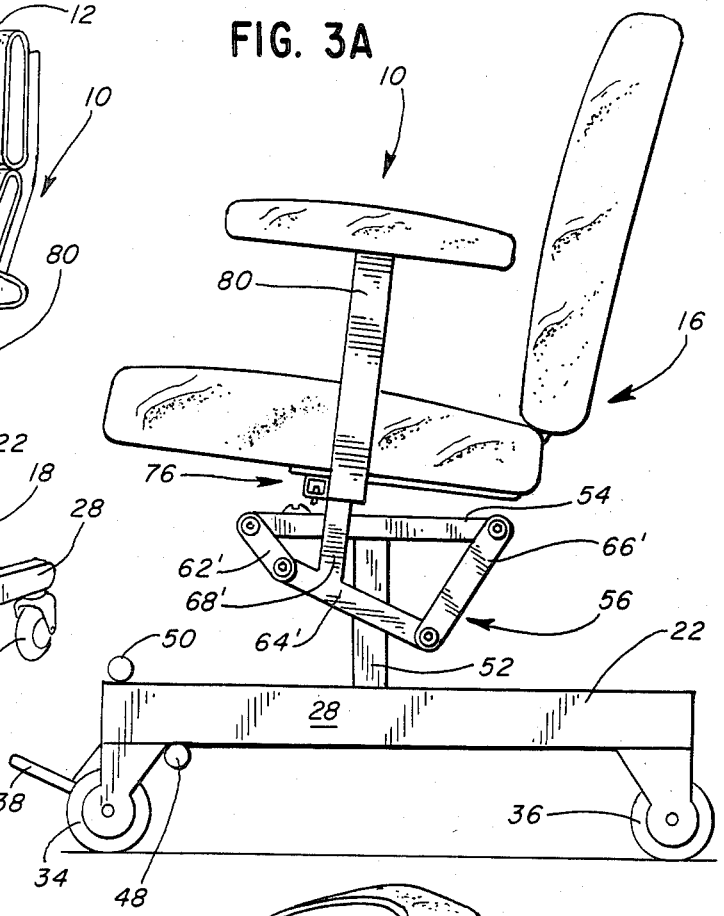
FIG. 2
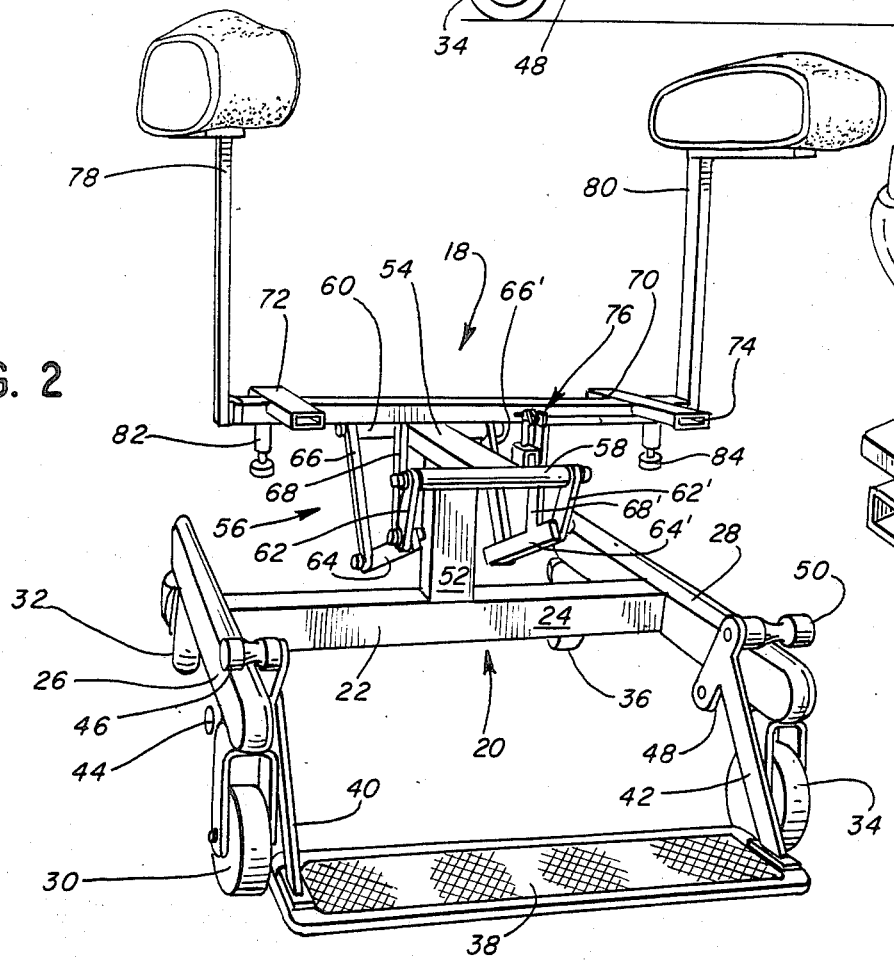
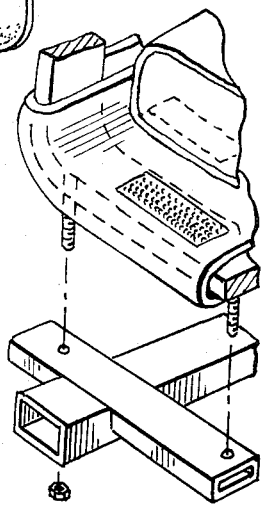
FIG. 8

FIG. 9
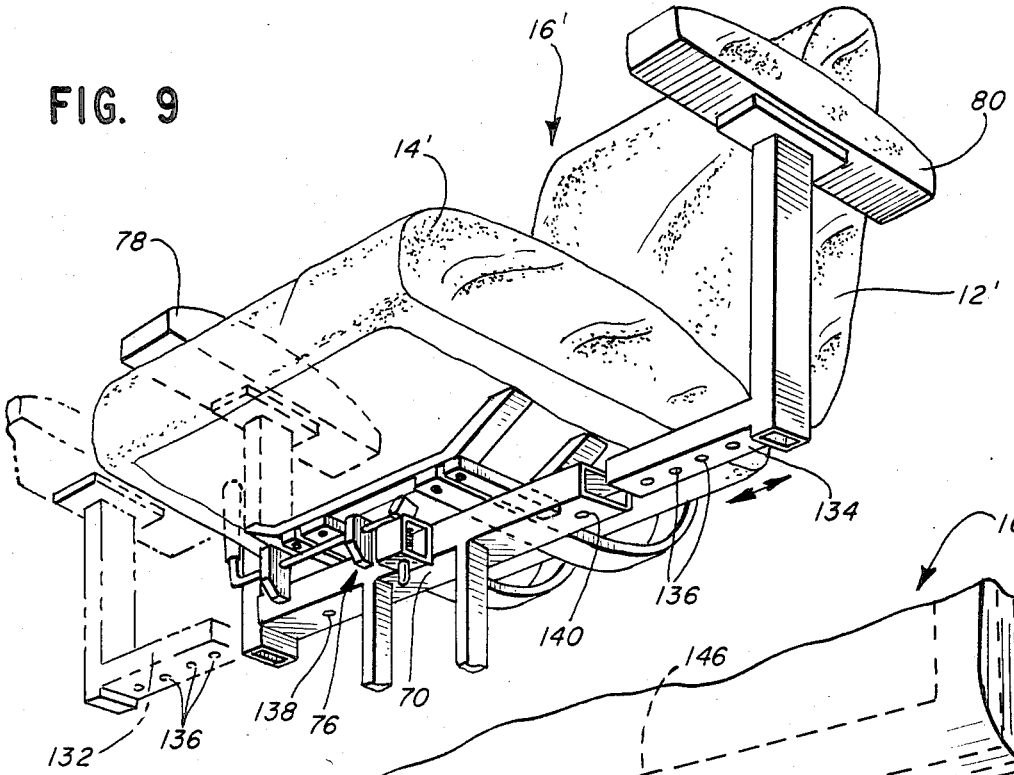
FIG. 10
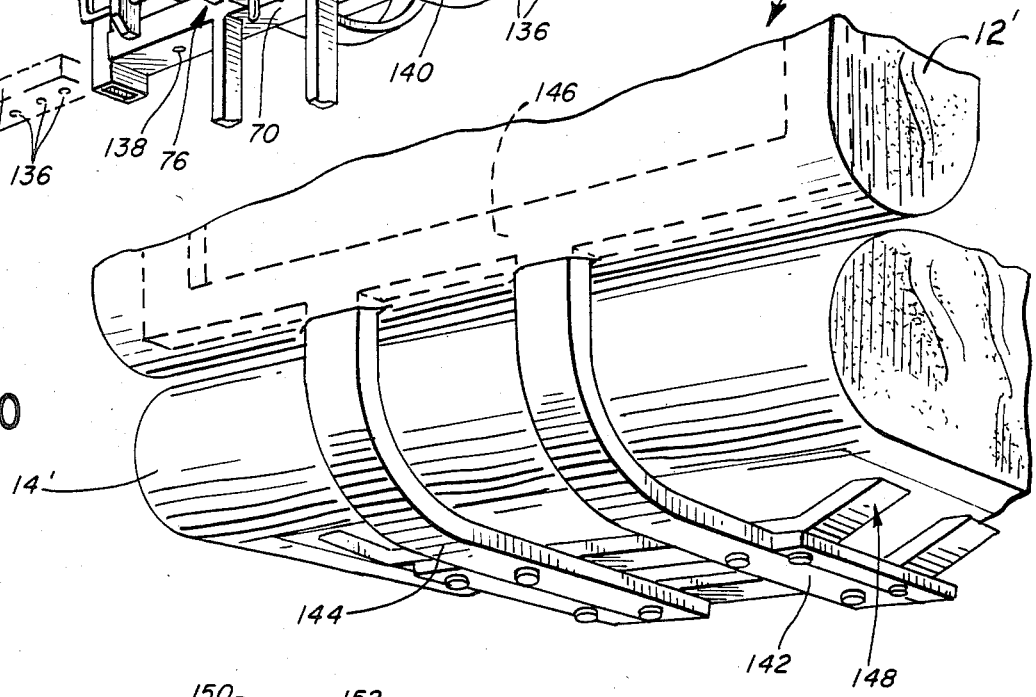
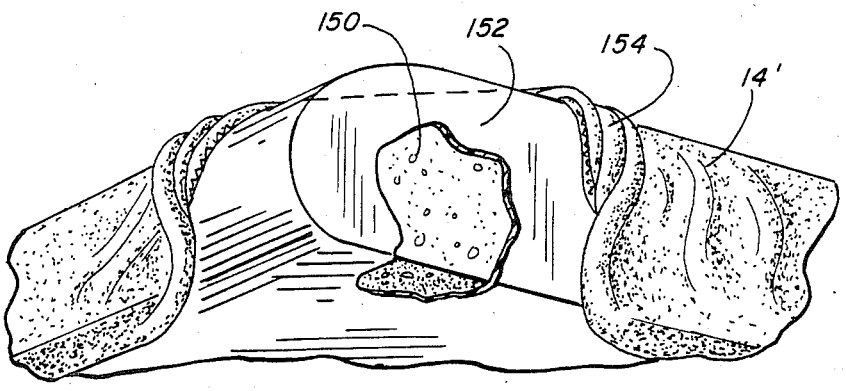
FIG. 11

MOBILE ROCKING WHEELCHAIR WITH POSITION LOCKING MEANS

BACKGROUND OF THE INVENTION

This invention relates generally to mobile rocking wheelchairs and more particularly, relates to a wheelchair of the character described which has releasable means for selectively locking the chair seat against rocking motion in a substantially non-inclined position which enables the occupant to move or be moved out of the chair more easily and readily. The wheelchair embodying the invention is further characterized by a construction which is economical and sturdy so as to be attractive for use by occupants in hospitals, nrusing homes and/or by disabled persons.

It is known that rocking and/or bouncing motion can render therapeutic and/or relaxing benefits for handicapped persons, such as those having muscle, spinal, and/or other disorders. Persons having such disorders commonly are confined to a wheelchair for their transportation because they are not ambulatory. When it is desired to provide such persons with the benefits of rocking and/or bounding motion, it has been necessary to physically move such persons from conventional wheelchairs to other seating devices which enable the handicapped person to rock and/or bounce in the seating device, as desired.

Stationary chairs with rockable or tiltable seats are well known, such as representated by U.S. Pat. Nos. 4,167,288 or 3,637,255 for instance. Rocker-type wheelchairs are known generally, such as represented by U.S. Pat. Nos. 4,118,046, 3,455,600, 3,712,671, 3,415,531.

U.S. Pat. Nos. 4,544,200 and 3,917,312 disclose wheelchairs with spring assemblies for desired movement by the user. U.S. Pat. No. 4,477,118 discloses an office-type chair providing a controlled tilt rocker on a mobile pedestal.

U.S. Pat. No. 3,379,473 discloses a stationary chair which has locking means for locking the chair against rocking movement when it is moved into its reclining position. U.S. Pat. No. 4,383,714 shows a rockable chair on a wheeled pedestal and which has a locking feature to lock the backrest in various inclined positions, but the locking feature is not concerned with rocking movement of the chair.

U.S. Pat. No. 3,848,924 discloses a mobile, reclining platform rocking chair which includes means for preventing movement of the chair when the leg rest is partially or fully retracted.

The wheelchair embodying the invention utilizes a simple and economical parallel four bar linkage assembly for achieving controlled rocking movement of the chair seat. The parallel linkage assembly is operationally mounted to a horizontal cross-strut or member supported on the vertical standard of a mobile pedestal. A chair seat support frame is operationally connected to said assembly with a chair seat and backrest mounted on said support frame. A releasable locking mechanism is provided for locking the chair seat against rocking movement in a substantially nonreclining or inclined position so as to permit a user easily and readily to lift his body off of the seat by arm movement pressing downwardly on adjacent armrests of the chair for egress from the chair. The locking mechanism is located within convenient reach of the occupant of the chair.

Further, the wheelchair embodying the invention has removable and laterally adjustable armrest members mounted on the support frame for lateral egress from the chair or for accommodating patients of larger girth. The wheels of the mobile pedestal have conventional locking members for restraining movement of the chair when a patient wishes to leave the chair or a patient enters the chair.

All of these advantages are achieved while still providing a wheelchair characterized further by its sturdy and reliable appearance.

SUMMARY OF THE INVENTION

A mobile rocking wheelchair having a mobile pedestal with a vertically oriented standard, a cross-strut or member supported on the standard, a parallel four bar linkage assembly operationally mounted to the cross-strut and a chair seat support frame operationally connected to the assembly with a seat and backrest mounted on the support frame. A releasable locking assembly is provided within convenient reach of the chair's occupant for locking the chair seat against rocking movement in a substantially non-inclined position for egress from the chair and for unlocking the assembly to permit rocking movement, as desired.

The support frame has means for installing an armrest member on opposite sides of the chair seat which enable the armrest members to be selectively locked against movement in adjustable positions laterally relative to the seat or to be removed so as to permit an occupant to exit laterally from the chair. Locking means are provided on the pedestal for restraining rolling movement of the wheels.

DESCRIPTION OF THE DRAWINGS

FIG. 1 is a perspective view of the rocking wheelchair embodying the invention;

FIG. 2 is a perspective view of the total support frame structure for the wheelchair of FIG. 1, but with the chair seat and backrest unit omitted;

FIG. 3A is a side elevational view of the wheelchair embodying the invention in a normal non-rocking position, the wheelchair being illustrated with a modified chair seat and backrest unit;

FIG. 8 is a fragmentary perspective view partially in section to illustrate mounting of the chair seat and backrest unit on a support assembly;

FIG. 9 is a perspective view taken from a vantage point below the chair seat and backrest unit to show details for adjustable mounting of the armrest members of the wheelchair;

FIG. 10 is a fragmentary rear perspective view of the chair seat and backrest unit illustrated in FIGS. 3A, 3B and 3C; and FIG. 11 is a fragmentary perspective view partially in section to illustrate a feature of the chair seat of the unit shown in FIG. 3A.

DESCRIPTION OF THE PREFERRED EMBODIMENTS

Figure 3B:
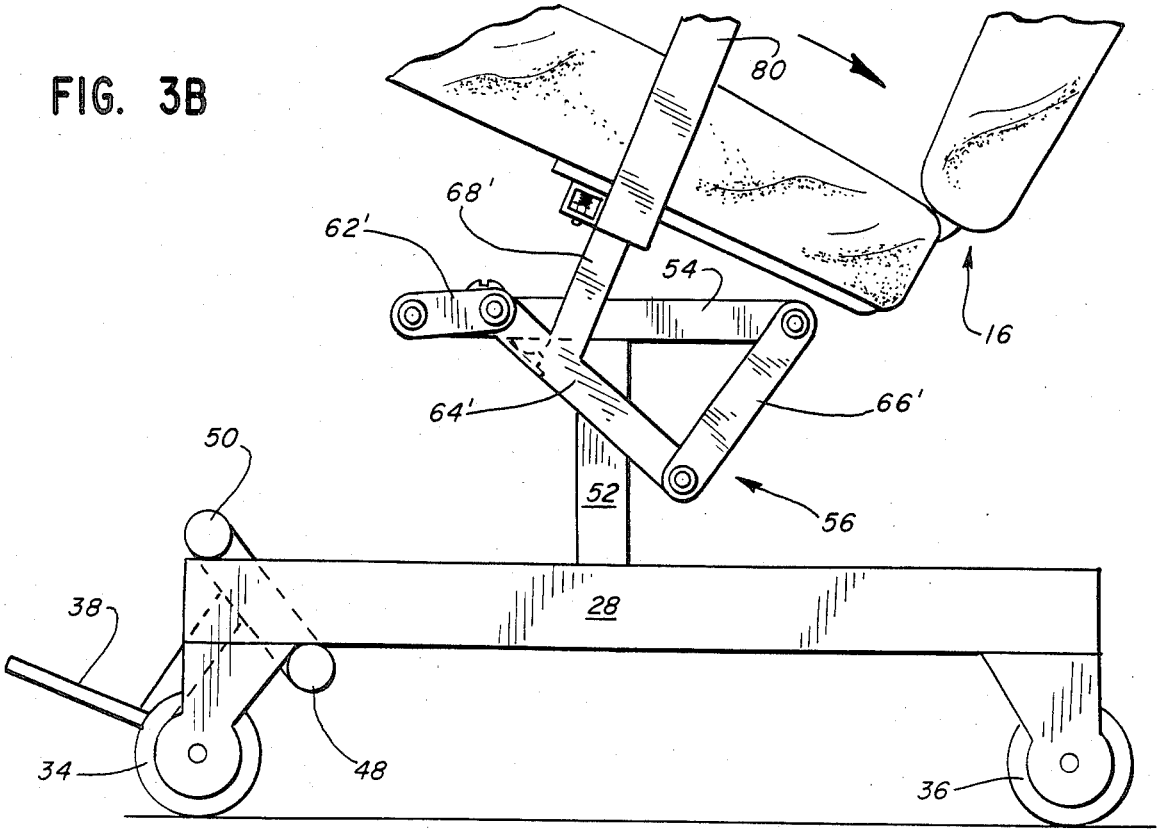
FIG. 3B is a fragmentary side elevational view of the wheelchair of the invention in a rearwardly inclined position assumed by the chair seat and backrest unit during rocking.

Referring to FIG. 1, a mobile rocking wheelchair embodying the present inention is designated generally by the reference numeral 10. The wheelchair 10 includes a backrest 12 and a seat 14, forming a unit 16, which can be one of any number of different seat and backrest units.

As illustrated best in FIG. 2, the wheelchair 10 includes a base support unit 18 upon which the unit 16 is mounted. The base support unit 18 includes a mobile pedestal 20, which has an H-shaped frame 22. The frame 22 has a cross support member 24 connecting a pair of outer wheel support members 26 and 28. EAch of the members 26 and 28 have a pair of respective pivotable wheel assemblies 30, 32 and 34, 36 mounted thereon. The wheel assemblies preferably each have a conventional locking and release member (not illustrated) for restraining movement of the chair 10, when desired.

A footrest 38 is slidably mounted onto the wheel members 26 and 28 by a pair of support arms 40 and 42. Each of the support arms include a pair of bearings or rollers 44, 46 and 48, 50 mounted on opposite sides of the members 26 and 28 and slidable thereon. The footrest 38 thus can be moved back out of the way for a patient to enter or exit the chair (FIG. 3C). The footrest 38, although illustrated in a fixed orientation, also can be adjustable to different heights to accommodate the size of different patients.

The support unit 18 includes a vertically oriented support or standard 52, upon which is mounted a cross-strut or support member 54. The member 54 includes a parallel four bar linkage assembly 56 operatively mounted thereon, with the member 54 forming the frame or first bar of the assembly. The member 54 has a crosspin 58 mounted at one end thereof and a crosspin 60 mounted at the other end thereof.

The assembly 56 has a pair of second bars 62, 62' pivotably mounted at one end to the ends of the crosspin 58. A pair of third bars 64, 64' are pivotably connected at one end to the other end of the bars 62, 62'. A pair of fourth bars 66, 66' are pivotably connected at one end to the other end of the bars 64, 64'. The other ends of the bars 66, 66' are pivotably mounted to the ends of the crosspiece 60 to close the four bar linkage. Each of the bars are mounted by pivot pins or bolts, not numbered for convenience.

The third bars 64, 64' have a chair unit or seat support bar 68, 68' fixedly mounted at one end thereto or formed therewith. A chair unit or seat support frame 70 is fixedly mounted onto the other ends of the support bars 68, 68'. The support frame 70 includes a pair of seat unit cross support members 72 and 74.

Figure 6:
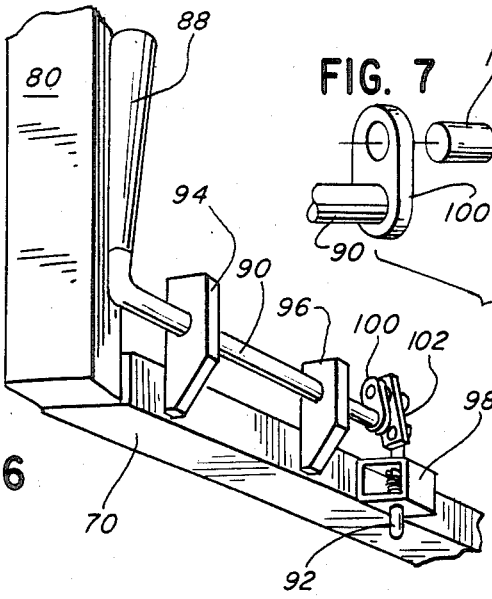
FIG. 6 is a fragmentary perspective view of the locking means and release lever for moving the locking bolt selectively.
Figure 7:
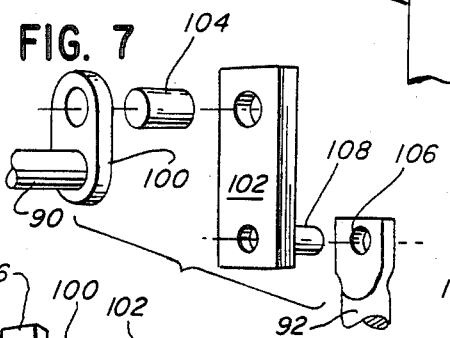
FIG. 7 is a fragmentary exploded perspective view of the over center locking feature for moving the locking bolt selectively.

The unit 18 includes a releasable locking mechanism 76, which will be described more fully with respect to FIGS. 4–6. The locking mechanism 76 is utilized to lock the chair into one non-rocking position for entering and exiting the chair 10.

The support frame 70 has open outer ends (FIGS. 8 and 9), into which are engaged a pair of armrests 78 and 80. The armrests 78 and 80 are removable and laterally adjustable, as will more completely be described with respect to FIG. 9. The armrests 78 and 80 are locked into various positions and released by conventional spring pin mechanisms 82 and 84 mounted to the bottom of the frame 70.

Figure 3C:
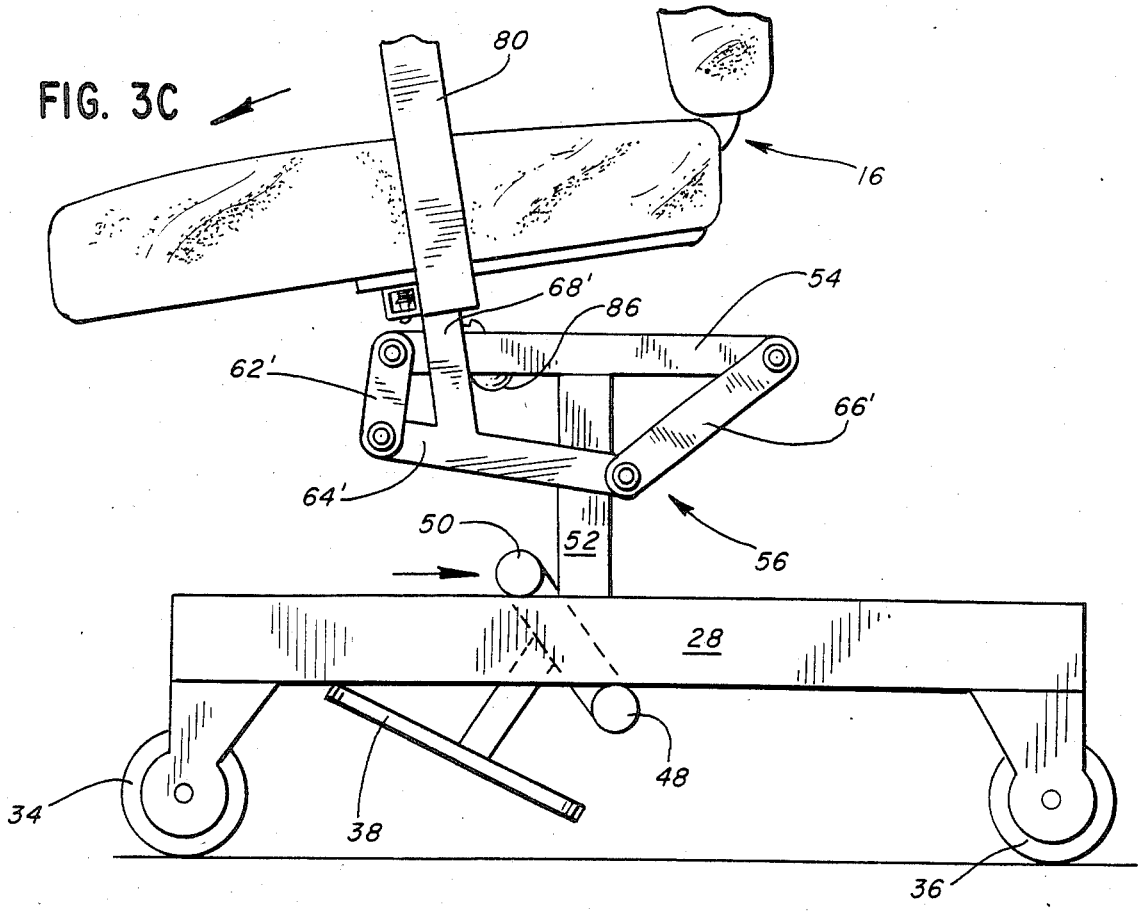
FIG. 3C is a fragmentary side elevational view of the wheelchair in the forwardly inclined position assumed by the chair seat and backrest unit during rocking.

Referring now to FIGS. 3A–3C, the rocking movement of the wheelchair 10 is most clearly illustrated. The chair 10 is illustrated in an upright middle position in FIG. 3A, in a rearwardly inclined position in FIG. 3B and in a forwardly inclined position in FIG. 3C. The wheelchair 10 thus can be seen as providing a full rocking motion on the four bar assembly 56. The assembly 56 provides a sturdy and reliable yet non-complex mechanism without complicated springs and other linkages which are prone to mechanical failure. The chair 10 can include a bumper 86 mounted on the strut 54 to provide an inclined limit position as illustrated in FIG. 3B.

Figure 4:
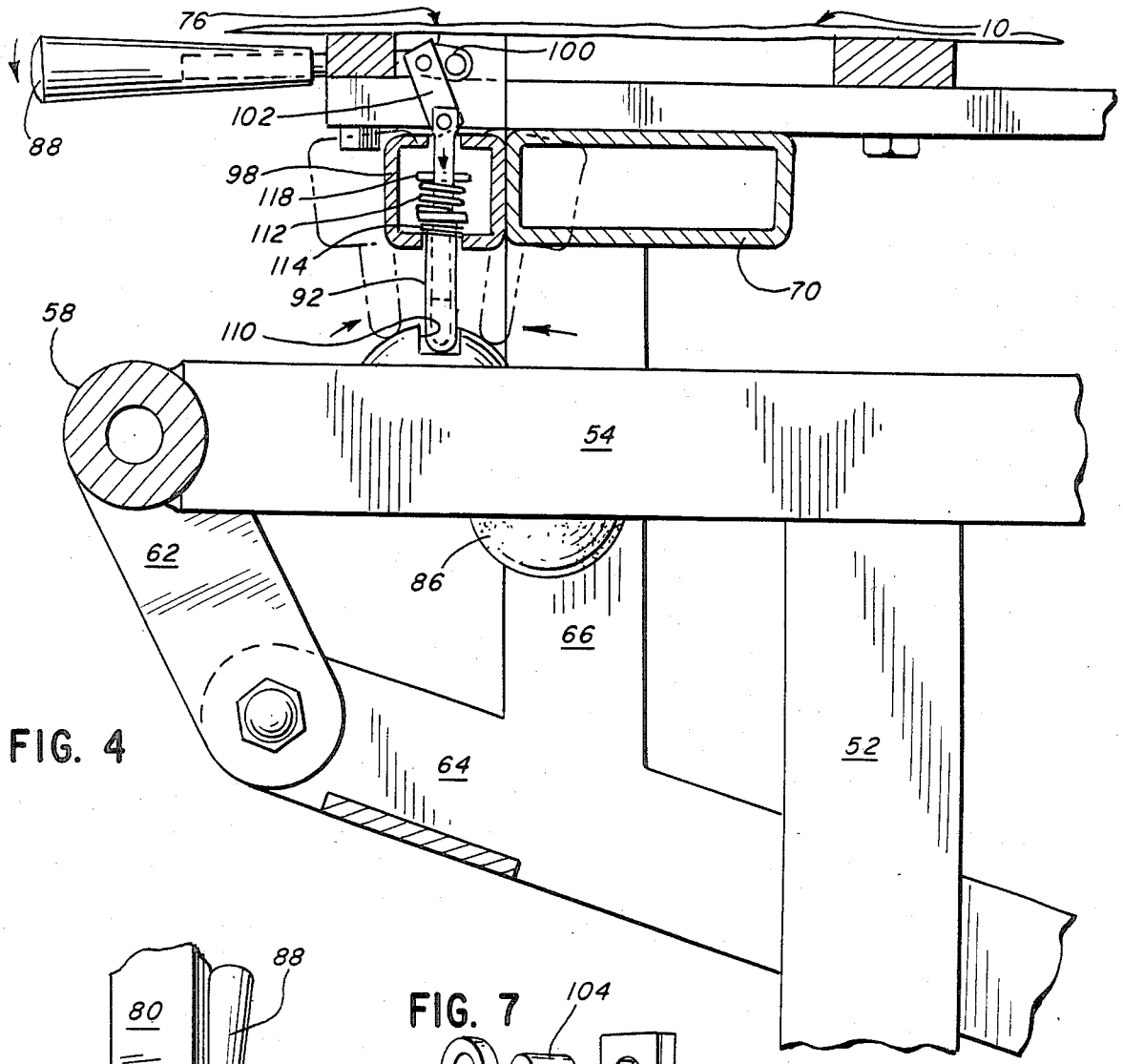
FIG. 4 is a fragmentary side elevational view of the wheelchair in its locked position for exit therefrom by an occupant, the chair seat being shown in a substantially horizontal position.
Figure 5:
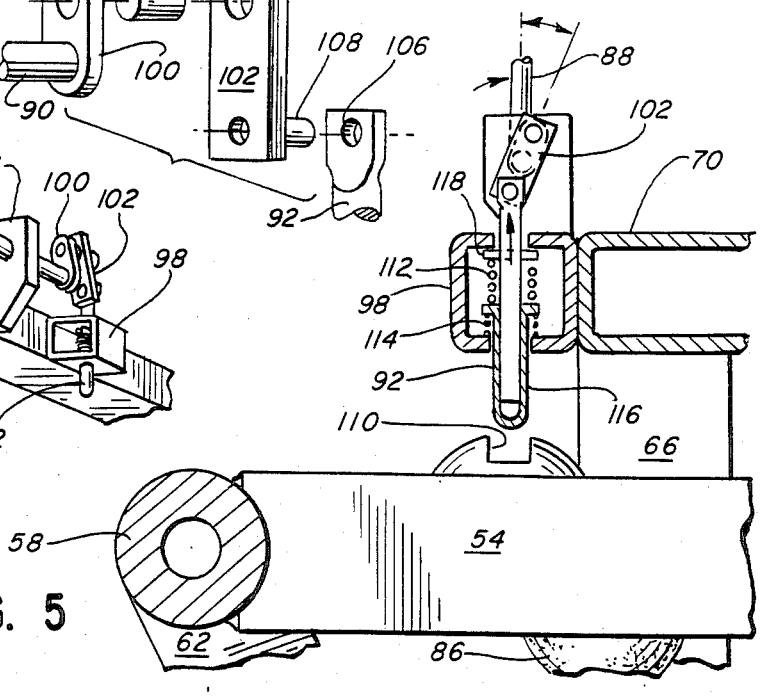
FIG. 5 is a fragmentary side elevational view partially in section to illustrate the release of the locking mechanism shown in FIG. 4.

The operation of the locking mechanism 76 is best illustrated in FIGS. 4–7. The locked position of the mechanism 76 is illustrated in FIG. 4, while the release position is illustrated in FIG. 5. The mechanism includes a locking and release lever 88, which is mounted at an angle onto an operating rod 90. The rod 90 connects the lever 88 to a spring loaded locking pin or bolt 92.

The rod 90 is pivotably mounted in a pair of support brackets 94 and 96, which brackets are mounted on the support frame 70. The pin 92 is retained in a bracket 98, which bracket also is mounted onto the support frame 70. The rod 90 is fixedly mounted at the end opposite the lever 88 to one end of a connecting bar 100. The bar 100 is pivotably connected at its other end to a second connecting bar 102 by a pivot pin 104. The other end of the bar 102 is pivotably connected to an aperture 106 in the top of the pin 92 by another pivot pin 108.

The lever 88 is positioned adjacent one of the armrests 78 or 80 for ease in utilization by a patient sitting in the chair 10. When the patient is going to enter or exit the chair 10, the lever 88 is moved from a substantially vertical position as illustrated in FIG. 5, to a substantially horizontal position with the chair 10 in the locking position illustrated in FIG. 4. The movement of the lever 88 toward the horizontal position (FIG. 4) rotates the rod 90 which in turn pivots the bar 102 from the over center released position (FIG. 5) to the locked lowermost position (FIG. 4). The pin 92 is thus driven downward into a locking channel, slot or groove 110 formed on the strut 54. The slot 110 can be formed in any number of ways to provide a depth sufficient to prevent lateral or rocking motion of the chair 10.

The locking pin 92 preferably is biased into the released position by springs 112 and 114. The pin 92 can include a sleeve member 116. The spring 114 biases the sleeve member 116 toward the release position and the spring 112 biases the pin 92 by bearing against a flange 118. A single spring 112 could be utilized if the sleeve 116 is eliminated or fixedly secured to the pin 92.

Referring to FIG. 8, the mounting of one chair unit 16 is best illustrated. The unit 16 includes a pair of curved support members, only one of which 120 is illustrated. The support members are first covered by a material layer 122, such as vinyl. The support members 120 then are mounted to the support members 72 by a plurality of bolts 124 and nuts 126. A seat cushion 128 and back cushion (not illustrated) then can be secured to the layer 122, such as by hook and loop-type fastners 130.

The removable and adjustable armrests 78 and 80 are best illustrated in FIG. 9. The armrests include respective support arms 132 and 134, each of which includes a plurality of apertures 136 spaced along the length thereof. The apertures 136 are adjusted and engaged as desired by the spring pins 82 and 84 through respective apertures 138 and 140 in the frame 70. The armrests 78 and 80 are laterally adjusted for the size of the patient utilizing the chair 10 and can be totally removed when desired.

A second seat unit 16' is illustrated in FIGS. 9–11. The unit 16' includes a pair of curved support members 142 and 144, which can be mounted as described above onto the frame 70. The support members 142 and 144 can be connected to an internal backrest support 146 onto which the backrest 12' is formed. Likewise, the seat 14' is formed onto a frame mounted onto the support members 142 and 144.

Referring to FIG. 11, the backrest 112' and the seat 14' can be formed from an inner frame member 150, covered by a plastic liner 152 and covered by an outer material 154 to form a cover for the seat 14'.

Modification and variations of the present invention are possible in light of the above teachings. The seat units can be separately supplied if desired. The size and number of the components is not critical and can vary without altering the functions of the chair 10. It is therefore to be understood that within the scope of the appended claims, the invention may be practiced otherwise than as specifically described.

What is claimed and desired to be secured by Letters Patent of the United States is:

1. A mobile rocking wheelchair, comprising:

a mobile base support unit said unit including an H-shaped frame having a pair of outer wheel support members and a cross support member connecting said pair of wheel support members, each of said wheel support members having a pair of substantially identical wheels mounted thereto;

a single pedestal mounted on said unit H-shaped frame cross support member and having substantially parallel four bar linkage assembly means mounted thereon for providing a rocking motion to a chair unit mounted on said assembly means, including a fixed support frame mounted on said assembly means with said chair unit mounted thereon, said assembly means including a first fixed frame bar mounted onto said pedestal and three pairs of interconnected pivotable bars mounted on opposite sides of said frame bar to provide said rocking motion, a first and second pair of said interconnected bars are mounted at one end to said frame bar and the third pair of bars is interconnected to the second ends of said respective first and second pair of bars, said support frame being unitarily mounted by a chair support bar onto said third pair of bars, said first pair of bars having a length substantially shorter then said second pair of bars and said second pair of bars having a length substantially shorter than said third pair of bars and said frame bar having a length greater than the lengths of said first, second and third pair of bars; and locking means for locking said chair unit into a non-rocking position.

2. The wheelchair as defined in claim 1 wherein said support frame includes a pair of armrests adjustably mounted thereto.

3. The wheelchair as defined in claim 2 wherein said armrests include removable support arms adjustably insertable into open ends of a support member of said support frame.

4. The wheelchair as defined in claim 2 wherein said locking means include a pin operatively movable from a released position to a locked position, said pin being mounted on said support frame and engageable in said locked position with a slot fixed to said first fixed frame bar.

5. The wheelchair as defined in claim 4 wherein said pin includes means biasing said pin toward the released position and a lever operatively coupled to said pin to move said pin between the released and locked positions.

* * * * *